United States Patent [19]

Nishimi

[11] 4,258,344

[45] Mar. 24, 1981

[54] SMALL-SIZED POWER RELAY

[75] Inventor: Ichiro Nishimi, Tokyo, Japan

[73] Assignee: Kabushiki Kaisha Saginomiya Seisakusho, Tokyo, Japan

[21] Appl. No.: 57,075

[22] Filed: Jul. 12, 1979

Related U.S. Application Data

[63] Continuation-in-part of Ser. No. 27,459, Apr. 5, 1979, abandoned, which is a continuation of Ser. No. 862,851, Dec. 21, 1977, abandoned.

[51] Int. Cl.[3] ..... H01H 67/02

[52] U.S. Cl. ..... 335/129; 335/188

[58] Field of Search ..... 335/127, 128, 129, 188, 335/189

[56] References Cited

U.S. PATENT DOCUMENTS

| | | | |
|---|---|---|---|
| 2,456,112 | 12/1948 | Dodd | 335/188 |
| 2,978,591 | 4/1961 | Ringger | 335/188 |
| 3,307,127 | 2/1967 | Leo | 335/188 |

OTHER PUBLICATIONS

Japanese Utility Model Publication No. 51-27012, Kabushiki Kaisha Saginomiya Seisakusho.

*Primary Examiner*—George Harris

*Attorney, Agent, or Firm*—Armstrong, Nikaido, Marmelstein & Kubovcik

[57] ABSTRACT

A small-sized power relay for automatic control of an air conditioner in response to the signal from an electronic thermostat. This relay, being operative in response to an ultra low current from the electronic thermostat, is instrumental in switching on and off the large current used in air-conditioning. Further, the manufacturing cost is substantially reduced.

7 Claims, 6 Drawing Figures

SMALL-SIZED POWER RELAY

RELATED APPLICATION

This application is a continuation-in-part of my copending application Ser. No. 027,459, filed Apr. 5, 1979, which is a continuation application of my prior application Ser. No. 862,851, filed Dec. 21, 1977, both abandoned.

BACKGROUND OF THE INVENTION

The present invention relates to a small-sized power relay and, more particularly, to a small-sized power relay used in combination with an electronic thermostat for automatic control of an air conditioner.

Conventionally, a temperature sensor of the thermostat employs Freon gas therein. The temperature difference needed by this type of temperature sensor for initiating switching on and off is 2° to 3° C. as measured in liquid. Nowadays, the gas type sensor is being replaced by an electronic type one which, in addition to being suitable for remote control, has the capacity to sense a temperature difference of 0.3° C. as measured in liquid. However, a power relay for use in combination with the electronic type temperature sensor is needed to be effectively operative in response to the ultra-low signal current from the sensor.

SUMMARY OF THE INVENTION

It is an object of the present invention to provide a power relay which is small-sized and capable of controlling a large current in the drive circuit of the air conditioner in response to a low control current.

It is another object of the present invention to provide a highly sensitive power relay with a simple small structure which can be manufactured at a low cost.

The above and other objects are realized by a small-sized power relay according to the present invention, which power relay comprises an open-top relay section housing; an electromagnet disposed in said housing adapted to be energized and de-energized by external signals; a magnetizable lever pivotally supported relative to said housing and extending within the magnetic field of said electromagnet; an adjustable tension spring means attached to said magnetizable lever at its one end and to said housing at its other end for urging said lever away from the electromagnet; a non-conductive open-bottom switch section housing attached on the upper portion of the relay section housing; a fixed contact mounted on the inside wall of said switch section housing; a movable contact means provided opposite said fixed contact within said switch section housing, said movable contact means including leaf spring means attached to said inside wall of the switch section housing at its one end and carrying a movable contact at its other end for normally pressing said movable contact onto said fixed contact; and push rod means for transmitting a lever action attributable to said adjustable tension spring means to said leaf spring means, the urging force of said lever action being capable of adjustment to be greater than the urging force of said leaf spring means but less than a resultant force of the urging force of said leaf spring means and the magnetic attraction exerted on said lever when said electromagnet is energized whereby said movable contact is kept pressed onto said fixed contact during the energization of the electromagnet and detached from the same during its de-energization.

BRIEF DESCRIPTION OF THE DRAWINGS

The nature, principle and details of the present invention, as well as its further characteristics and advantages, will become more apparent from the following detailed description with respect to a preferred embodiment of the invention when read in conjunction with the accompanying drawings.

DETAILED DESCRIPTION OF THE PREFERRED EMBODIMENT

Figure 1:
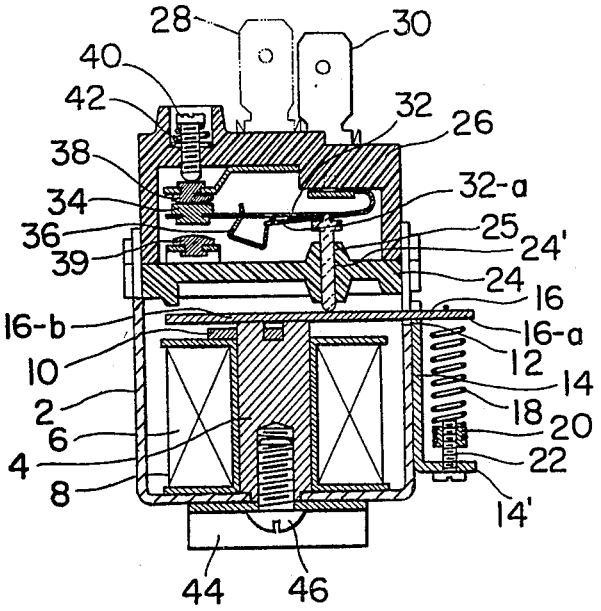
FIG. 1 is a sectional front view of the power relay according to the present invention.
Figure 2:
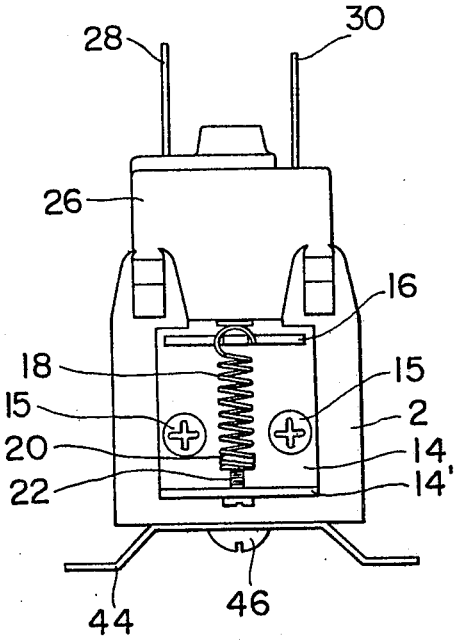
FIG. 2 is a side view of FIG. 1.

Referring to FIGS. 1 and 2, the numeral 2 designates an open-top relay section housing made of a magnetizable material. An iron core 4 is mounted substantially in the center of the floor of said housing 2. Around said iron core 4, a coil 6 is wound to form an electromagnet 8 which is energized and de-energized in response to external signals. Said coil 6 is firmly held on iron core 4 by a fixing piece 10. Said fixing piece is preferably made of copper in order to prevent a rumbling/buzzing noise generated by said electromagnet 8. Said housing 2 is provided with a slot 12 on its vertical wall slightly above the level of the top of said electromagnet 8. A bracket member 14 is fixed on the outer wall of said housing 2 substantially below said slot 12 by screws 15. Through said slot 12, a magnetizable lever 16 extends above said electromagnet 8 and within the magnetic field thereof inside of said housing 2 and through said bracket member 14 outside of the housing 2. In this arrangement, said slot supports said lever 16 as a fulcrum. A tension spring 18 is attached to a first end portion **16*a* of said lever 16 at its one end. A nut 20 is attached to the other end of said tension spring 18. A horizontal extension 14' of said bracket member has a hole. A bolt 22 is inserted into said hole from below and screwed into said nut 20. A horizontal guide plate 24 is mounted on the inner wall of said housing 2 to extend over a second end portion 16*b* of said lever 16. Said second end portion 16*b* is urged away from the electromagnet by spring 18 at the time of its de-energization. Said guide plate 24 is provided with a guide hole 24'. A push rod 25 is slidably inserted into said guide hole 24' and supported by lever 16 therebelow to transmit a lever action attributable to said tension spring 18** to a center arm portion of triple arm metal structure which will be described later.

Figure 3:
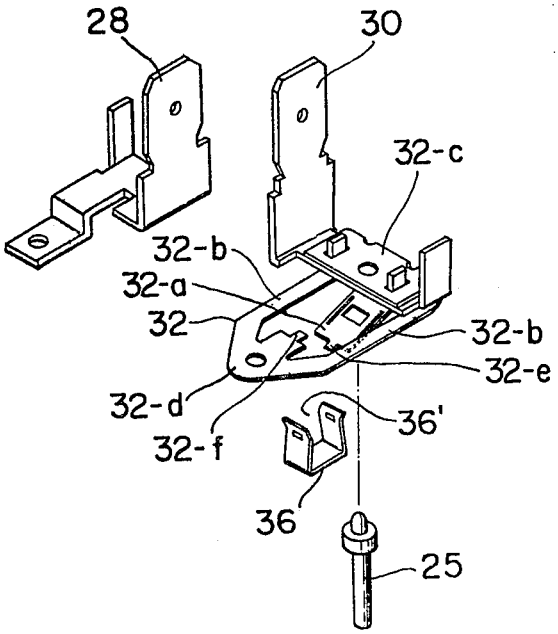
FIG. 3 is an exploded view of the assembly including first and second terminal plates, a triple arm metal structure, a rectangular spring and a push rod.

Numeral 26 designates an open-bottom non-conductive switch section housing. First and second metal terminal plates 28 and 30 pierce the top portion of said switch section housing 26, each having an outer terminal end projecting from said housing for electrical connection in the drive circuit of the air conditioner and an inner terminal end facing the inside of the housing. To the inner terminal end of second terminal plate 30, a triple arm metal structure 32 is attached at its folded end as shown in FIG. 3. Said structure 32 has one center arm portion 32*a* and two outside arm portions 32*b*. Said center arm portion 32*a* and two outside arm portions are connected with each other at one end 32*c* of said structure. However, said two outside arm portions are connected with each other at the other end 32*d* of said structure. Said center arm portion 32*a* branches off downwardly at an angle from said one end 32*c*, which is folded for fixedly attaching the same to the inner terminal end of second terminal plate 30. Said end portion 32*d* carries a movable contact 34 thereon. Center arm portion 32*a* and end 32*d* of said triple arm metal structure 32 carries first spigot 32*e* and second spigot 32*f* A rectangular shaped spring is bridged between the free end of said center arm portion 32*a* and said end 32*d* by inserting said spigots 32*e* and 32*f* into cuts formed on said rectangular shaped spring 36. A gap 36' of said rectangular spring 36 is wider than the spacing between the free end of center arm portion 32*a* and end 32*d* of said triple arm metal structure 32 when said center arm portion 32*a* is forced into the same plane as said end 32*d*. A fixed contact 38 is resiliently mounted on the inner terminal end of said first terminal plate 28 to allow a manual adjustment of screw 40 as depicted in FIG. 1, thus regulating the level of said fixed contact 38 from outside of the housing 26. Numeral 42 is a spring preventing loosening of screw 40. Said switch section housing 26 is inserted into the open-top electromagnet section housing 2 and fixed thereon above the level of guide plate 24. Numeral 44 designates a fixing plate and fixed on electromagnet section housing 2 by screw 46. A stop 39 is fixedly mounted on the inner wall of said housing 26 facing movable contact 34 on the other side of fixed contact 38. The adjustment of the small-sized power relay described will now be explained. If tension spring 18 is too slack, the end portion 16*b* of the lever 16 is pressed against iron core 4 under the urging force of triple arm metal structure 32 even if electromagnet 8 is not energized. At this time, movable contact 34 is pressed against fixed contact 38. Then, bolt 22 is manually rotated clockwise to tighten tension spring 18. As a result, lever 16 urges said push rod 25 upward. A further clockwise rotation of bolt 22 causes center arm portion 32*a* and rectangular spring 36 to perform a snap action of movable contact 34 which flies apart from fixed contact 38 until it abuts stop 39. A still further but slight clockwise rotation of bolt 22 completes the adjustment of the device. By doing so, the urging force of magnetizable lever 16 can be set to be greater than the urging force of triple arm metal structure but less than the resultant urging force of triple arm metal structure and the magnetic attraction exerted on the lever 16 when electromagnet 8 is energized.

Figure 4:
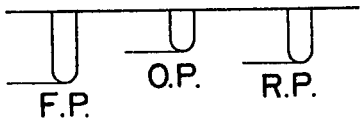
FIG. 4 is a figure showing positions taken by said push rod in respective stages of operation.

Referring to FIG. 4, F.P. means a "free position" of push rod 25 without the presence of a lever. O.P. means its "operative position", the position taken when pushed up by lever 16 at the time of de-energization of electromagnet 8. R.P. means "return position", the position taken when pushed down by triple arm metal structure 32.

Figure 5:
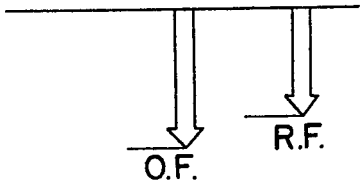
FIG. 5 is a figure comparing the force needed to balance the force of a tension spring means with the force of an over center toggle switch means.

Referring to FIG. 5, O.F. means an "opposing force" needed to bring movable contact 34 into contact with fixed contact 38 by overcoming the urging force of lever 16. R.F. means a "return force" exerted on push rod 25 by triple arm metal structure 32 alone.

Figure 6:
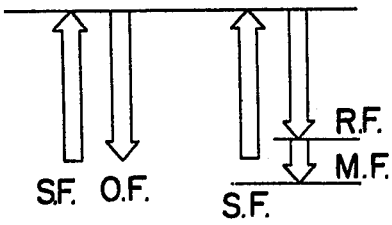
FIG. 6 is a comparative figure similar to FIG. 5 but shows the force of said tension spring means, the force needed to balance the same, the force of said over center toggle switch means and a magnetic force exerted on a lever at the time of energizing an electromagnet used in the power relay according to the present invention.

Referring to FIG. 6, S.F. means a "spring force", an urging force exerted on lever 16 by tension spring 18. M.F. means a "magnetic force" exerted on lever 16 when electromagnet 8 is energized. Since the resultant force of R.F. and M.F. exceeds S.F., the air conditioner is switched "ON", when M.F. is generated by energization of electromagnet 8. On the other hand, when M.F. stops due to de-energization of electromagnet 8, the switch moves to "OFF".

More specifically, when electromagnet 8 is energized, lever 16 is attracted by electromagnetism generated by said electromagnet 8. Push rod 25 follows the downward movement of said lever 16, permitting a downward movement of center arm portion 32*a*. However, end 32*d* carrying movable contact 34 thereon, is pushed up by rectangular spring 36 to press said movable contact 34 onto fixed contact 38. Thus, the air conditioner is switched "ON". When electromagnet 8 is de-energized, lever 16 is moved away from electromagnet 8 by the urging force of the tension spring 18. Said push rod 25 transmits the upward lever action to lift center arm portion 32*a* of said triple arm metal structure 32. However, said end 32*d* is pushed down by rectangular spring 36. As a result, movable contact 34 flies apart from fixed contact 38 and abuts against stop 39. Thus, the air conditioner is switched "OFF".

It is clear from the foregoing that the magnetic force can be minimized by setting S.F. slightly greater than O.F. by precise manual adjustment of the relay. In other words, the small-sized power relay according to the present invention functions in response to an exceedingly small signal transmitted from an electronic type temperature sensor. In addition, its size can be designed to be smaller than the conventional power relay, thus reducing the manufacturing cost.

The invention may be embodied in other specific forms without departing from the essential characteristics thereof. The present embodiment is illustrative and not restrictive, the scope of the invention being indicated by the appended claims rather than by the foregoing description, and all changes which come from within the meaning and range of equivalency of the claims are therefore intended to be embraced therein.

What is claimed is:

1. A small-sized power relay used in combination with an electronic type thermostat for automatic control of an air conditioner comprising (a) an open-top relay section housing;

(b) an electromagnet disposed in said housing adapted to be energized and de-energized by external signals;

(c) a magnetizable lever pivotally supported relative to to said housing and extending within the magnetic field of said electromagnet;

(d) an adjustable tension spring means attached to said magnetizable lever at its one end and to said housing at its other end for urging said lever away from the electromagnet;

(e) a non-conductive open-bottom switch section housing attached on the upper portion of the relay section housing;

(f) a fixed contact mounted on the inside wall of said switch section housing;

(g) a movable contact means provided opposite said fixed contact within said switch section housing, said movable contact means including leaf spring means attached to said inside wall of the switch section housing at its one end and carrying a movable contact at its other end for normally pressing said movable contact onto said fixed contact; and (h) push rod means for transmitting a lever action attributable to said adjustable tension spring means to said leaf spring means, the urging force of said lever action being capable of adjustment to be greater than the urging force of said leaf spring means but less than a resultant force of the urging force of said leaf spring means and the magnetic attraction exerted on said lever when said electromagnet is energized whereby said movable contact is kept pressed onto said fixed contact during the energization of the electromagnet and detached from the same during its de-energization.

2. A small-sized power relay as set forth in claim 1, wherein said open-top relay section housing is of magnetizable material.

3. A small-sized power relay as set forth in claim 2, wherein said magnetizable housing is provided with a slot, said ferromagnetic lever extends through said slot.

4. A small-sized power relay as set forth in claim 3, wherein said adjustable tension means includes a tension spring attached to said lever at its one end, a nut attached to the other end of said tension spring, a bracket member mounted on said relay section housing and having a horizontal extention, and a bolt attached to said horizontal extension for its axial rotation, said bolt being screwed into said nut.

5. A small-sized relay as set forth in claim 1, wherein said leaf spring means includes over center toggle spring means and there is further provided a stop on the inside wall of the switch section housing, said stop being disposed facing said movable contact on the other side of said fixed contact within the range of the action of said over center toggle spring means.

6. A small-sized power relay as set forth in claim 5, wherein said over center toggle spring means includes a triple arm metal structure, said structure including one center arm portion and two outside arm portions, said center arm portion and said two outside arm portions being connected with each other at one end of said structure, said two outside arm portions being connected at the other end of said structure, said center arm portion branching off downwardly at an angle from said one end, and a rectangular shaped spring bridged between the free end of said center arm portion and said other end of the triple arm metal structure.

7. A small-sized power relay as set forth in claim 6, wherein said push rod means includes a guide plate fixed on said relay section housing between said triple arm metal structure and said magnetizable lever, said guide plate having a guide hole, and a push rod slidably inserted into said guide hole and adapted for vertical movement under the pressure of said magnetizable lever to transmit its force to the center arm portion of said triple arm metal structure.

* * * * *